US010647146B2

(12) United States Patent
McDonald

(10) Patent No.: US 10,647,146 B2
(45) Date of Patent: May 12, 2020

(54) APPARATUS FOR, AND METHOD OF, MANUFACTURE OF A FOLDED-SUBSTRATE ARTICLE

(71) Applicant: George Wallace McDonald, Channel Islands (GB)

(72) Inventor: George Wallace McDonald, Channel Islands (GB)

( * ) Notice: Subject to any disclaimer, the term of this patent is extended or adjusted under 35 U.S.C. 154(b) by 455 days.

(21) Appl. No.: 14/441,836

(22) PCT Filed: Nov. 8, 2013

(86) PCT No.: PCT/GB2013/052942
§ 371 (c)(1),
(2) Date: May 8, 2015

(87) PCT Pub. No.: WO2014/072731
PCT Pub. Date: May 15, 2014

(65) Prior Publication Data

US 2015/0306896 A1 Oct. 29, 2015

(30) Foreign Application Priority Data

Nov. 9, 2012 (GB) ..... 1220232.1

(51) Int. Cl.
*B42D 15/00* (2006.01)
*B42C 11/02* (2006.01)
(Continued)

(52) U.S. Cl.
CPC ..... *B42D 15/008* (2013.01); *B31F 1/0045* (2013.01); *B42C 9/00* (2013.01);
(Continued)

(58) Field of Classification Search
CPC ..... B42D 15/008; B42D 13/00; B31F 1/0045; B42C 19/08; B42C 9/00; B42C 19/02; B42C 11/02
(Continued)

(56) References Cited

U.S. PATENT DOCUMENTS 4,083,551 A * 4/1978 St. Denis ..... B42C 1/10 270/52.18
4,681,500 A 7/1987 Rathert et al.
(Continued)

FOREIGN PATENT DOCUMENTS

DE 34 19 610 A1 12/1984
EP 1 712 495 A2 10/2006
(Continued)

OTHER PUBLICATIONS

International Search Report for PCT/GB2013/052942 dated Jan. 31, 2014.
(Continued)

*Primary Examiner* — Justin V Lewis
(74) *Attorney, Agent, or Firm* — JCIP; Joseph G. Chu; Jeremy I. Maynard

(57) ABSTRACT

A method and apparatus are provided for the manufacture of an article made up of a number of elements, including a resilient element, that are bonded together during the manufacturing process. The apparatus includes a guide track which defines a path along which the elements travel during the manufacturing process and a compression frame provided along at least part of the length of the track for compressing the resilient element as the resilient member travels along the path defined by the guide track. The process includes moving a combination of article precursor elements together along the guide track rails such that the compression frame acts to press the elements together during bond-
(Continued)

ing. The method and apparatus minimize misalignment of the elements and thereby improve quality of the finished article as well increasing production rates compared to conventional methods and apparatus.

17 Claims, 2 Drawing Sheets

(51) Int. Cl.

| | |
|---|---|
| ***B42C 19/02*** | (2006.01) |
| ***B42C 19/08*** | (2006.01) |
| ***B42C 9/00*** | (2006.01) |
| ***B31F 1/00*** | (2006.01) |
| ***B42D 13/00*** | (2006.01) |

(52) U.S. Cl.
CPC ..... *B42C 11/02* (2013.01); *B42C 19/02* (2013.01); *B42C 19/08* (2013.01); *B42D 13/00* (2013.01)

(58) Field of Classification Search
USPC ..... 412/9, 19, 20, 21, 22, 25, 29, 33, 34
See application file for complete search history.

(56) References Cited

U.S. PATENT DOCUMENTS

| | | | | |
|---|---|---|---|---|
| 5,800,110 | A * | 9/1998 | Georgitsis | B42C 13/003 412/1 |
| 2001/0014265 | A1* | 8/2001 | Holtmeir | B42C 11/04 412/5 |
| 2002/0089111 | A1 | 7/2002 | Tsuchiya et al. | |
| 2004/0056479 | A1 | 3/2004 | Fox et al. | |
| 2006/0231372 | A1 | 10/2006 | von Freden | |
| 2012/0087765 | A1 | 12/2012 | Suzuki | |

FOREIGN PATENT DOCUMENTS

| | | | | |
|---|---|---|---|---|
| EP | 2 439 159 | A1 | 4/2012 | |
| GB | 1 270 427 | A | 4/1972 | |
| GB | 2031798 | A * | 4/1980 | B42C 5/00 |
| GB | 2 259 295 | A | 3/1993 | |
| JP | 2003-226082 | A | 8/2003 | |

OTHER PUBLICATIONS

International Preliminary Report on Patentability for PCT/GB2013/052942 dated May 12, 2015.
Combined Search and Examination Report for GB 1220232.1 dated May 12, 2014.

* cited by examiner

APPARATUS FOR, AND METHOD OF, MANUFACTURE OF A FOLDED-SUBSTRATE ARTICLE

The present disclosure relates to an apparatus and method for production of an article. In particular, it relates to the apparatus for the manufacture of an article, and the method of operation of the apparatus.

Folded documents comprising an inner section with a front card and a back card are known in the art, for example inserts in magazines. In the production of such, outer stiff portions are attached to a folded sheet. However, the problem with the manufacture of such articles is that the folded sheet is resilient and thus is unstable as it is worked upon. Each folded sheet will extend to relieve the natural resilience of the material, which makes it difficult to align the combination of elements making up the article.

One method of resolving this problem is to press the resilient folded sheet for a significant amount of time, for example hours, prior to it being introduced to the apparatus. The problem with this technique, apart from introducing a lengthy period of time into the manufacturing process, is the folded sheet may still have a certain amount of resilience, and hence the problem is not completely removed. The uncertainty and instability introduced by any resilience of the folded sheet can cause the components of the article to become misaligned and either produce an article which has not been assembled correctly, or get jammed in any machine being used in their manufacture, hence slowing down manufacture of the articles.

Hence an apparatus and method which can manufacture such articles and overcome the issues associated with the resilience of the folded sheet, is highly desirable.

SUMMARY

Accordingly there is provided apparatus for the manufacture of an article, the article to comprise a number of elements to be bonded together including at least one resilient element, the apparatus comprising: a guide track which defines a path along which the elements travel during manufacture; and a compression frame provided along at least part of the length of the track for compressing the resilient element as it travels along the path defined by the guide track.

The compression frame may comprise at least one bearing surface for, in use, exerting a compression force on the elements moving along the track.

The guide track may comprise a first rail section which is substantially flat and defines a first plane of travel, a second rail section which is substantially flat and defines a second plane of travel offset from the first plane of travel, and an intermediate rail section which provides a transition between the first rail section and second rail section.

The first plane may be above the second plane. The intermediate rail section may be concave or flat.

The apparatus may further comprise a flight for urging the elements along the guide track.

The compression frame may comprise at least a first section and a second section, the first section and second section aligned with one another along at least part of the length of the track and independently mounted such that their position relative to one another may be adjusted.

The bearing surface may be arranged relative to the track rails such the distance between the bearing surface and the track rails decreases in the direction of travel along the bearing surface.

The bearing surface may be configured such that the distance between the bearing surface and the track reduces at a first rate to first value part way along the length bearing surface, and then reduces at a second rate along the rest of the length of the surface, where the second rate is less than the first rate.

Accordingly there is also provided a method of manufacturing an article using the apparatus of the present disclosure, the method comprising the steps of urging a resilient element along guide track rails; and compressing the resilient element as it travels along the guide track rails.

The method may further comprise the steps of: introducing a base element to the track; bringing the base element and resilient element together to form a first combination; moving the first combination along the guide track rails such that the compression frame acts to compress the resilient element and press the resilient element and base element together to thereby bond the resilient element and base element together.

The method may further comprise the steps of: introducing a top element to the track; bringing the top element and first combination together to form a second combination; moving the second combination along the guide track such that the compression frame acts to compress the resilient element and press the first combination and top element together to thereby bond the first combination and top element together.

The method may further comprise the step of introducing a bonding agent to one or both of the surfaces of the resilient element, base element or top element prior to pressing the elements together.

Accordingly there is further provided a folded document manufactured by the apparatus of the present disclosure using the method of the present disclosure, wherein the top element and base element comprise flat card and a resilient element comprises a folded sheet of paper.

Thus a folded document may be produced using the method and apparatus of the present disclosure, which overcomes the issues surrounding the natural resilience of resilient element making up the folded document.

BRIEF DESCRIPTION OF THE DRAWINGS

Examples of the present disclosure will now be described with reference to the accompanying drawings, in which.

DETAILED DESCRIPTION

Figure 1:
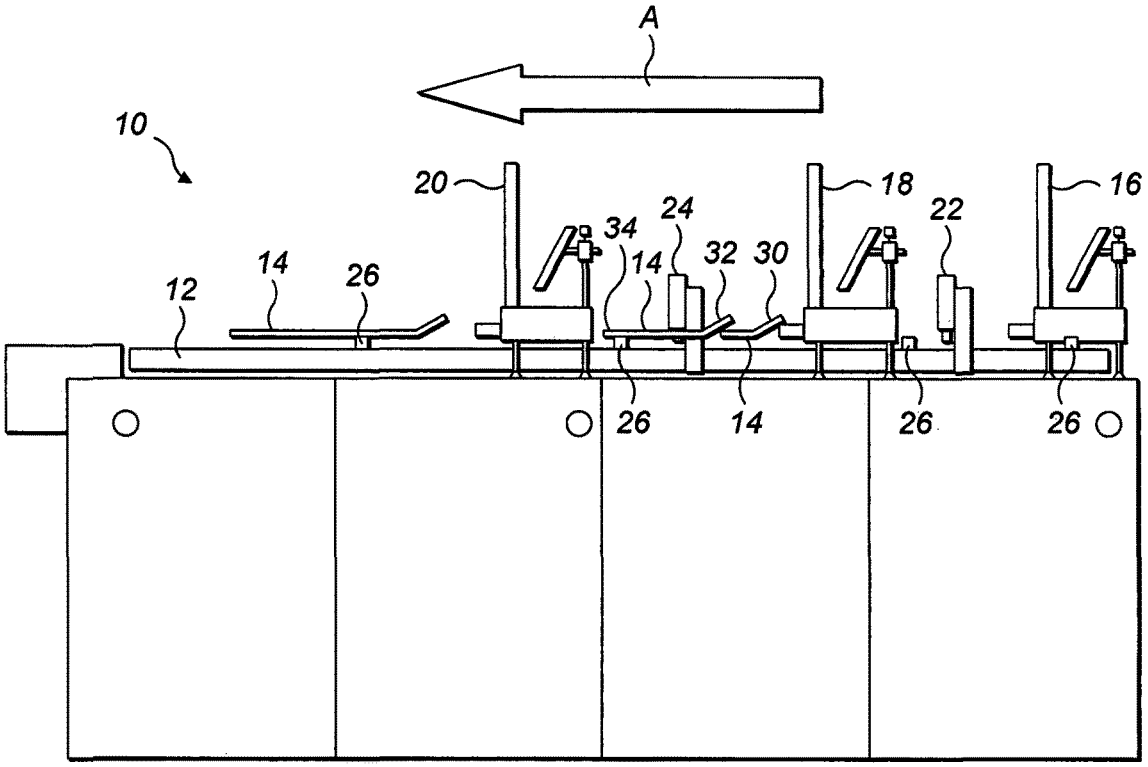
FIG. 1 shows a side view of the apparatus of the present disclosure.

FIG. 1 shows a side view of an example apparatus 10 according to the present disclosure. The apparatus 10 comprises a guide track 12 and a compression frame 14 provided along at least part of the length of the guide track 12. The apparatus 10 further comprises a first feeder 16, a second feeder 18 and a third feeder 20 aligned along the length of the track 12. The apparatus 10 is also provided with a first glue gun 22 and a second glue gun 24 also aligned along the length of the track 12. The first glue gun 22 is located between the first feeder 16 and the second feeder 18, and the second glue gun 24 is located between the second feeder 18 and the third feeder 20. There is also provided a flight 26 which is moveable along the track 12 on a powered conveyor belt type arrangement. The flight comprises a waist 60 extending upwards away from the conveyor belt towards a lip 62 at its top end. For the avoidance of doubt, in operation the direction of travel of articles through the apparatus 10 is from right to left as shown by arrow A in the Figures. The flight 26 extends above the upper surface of the track 12.

Figure 2:
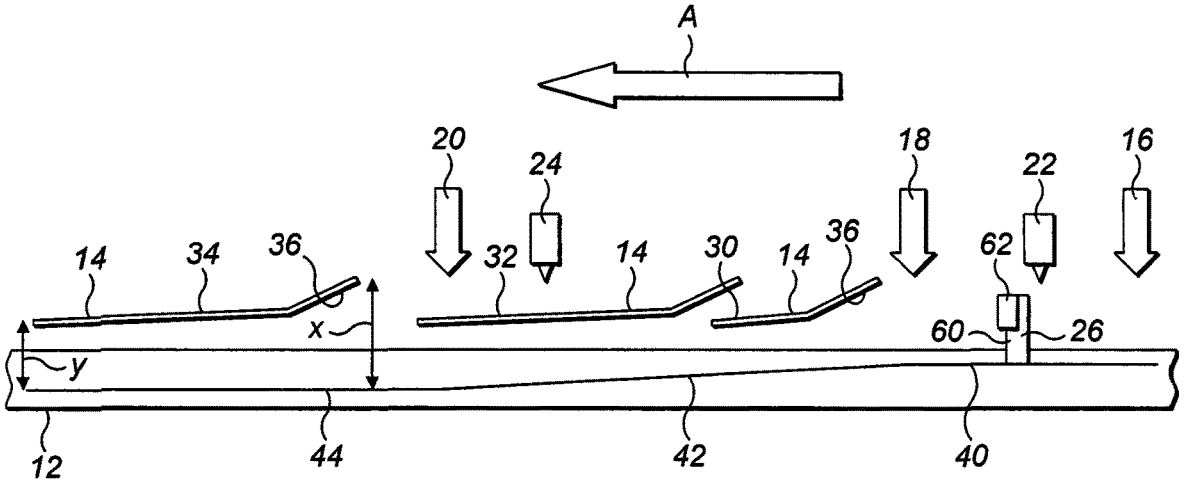
FIG. 2 shows a part of the track which is provided as part of the apparatus shown in FIG. 1.

FIG. 2 shows an enlarged view of the compression frame 14 and track 12, with other details of the apparatus 10 removed. The compression frame 14 comprises at least a first section 30 and a second section 32. In the example shown also comprises a third section 34. Each section of the compression frame comprises two parallel rods, side by side, with a gap between them, such that the flight 26 may extend into the gap between the rods. The first, second third sections 30,32,34 are aligned with one another along at least part of the length of track 12 in the direction A. The compression frame sections 30,32,34 are independently mounted such that their position relative to one another may be adjusted. Each of the compression frame sections 30,32,34 comprise a bearing surface 36.

Figure 3:
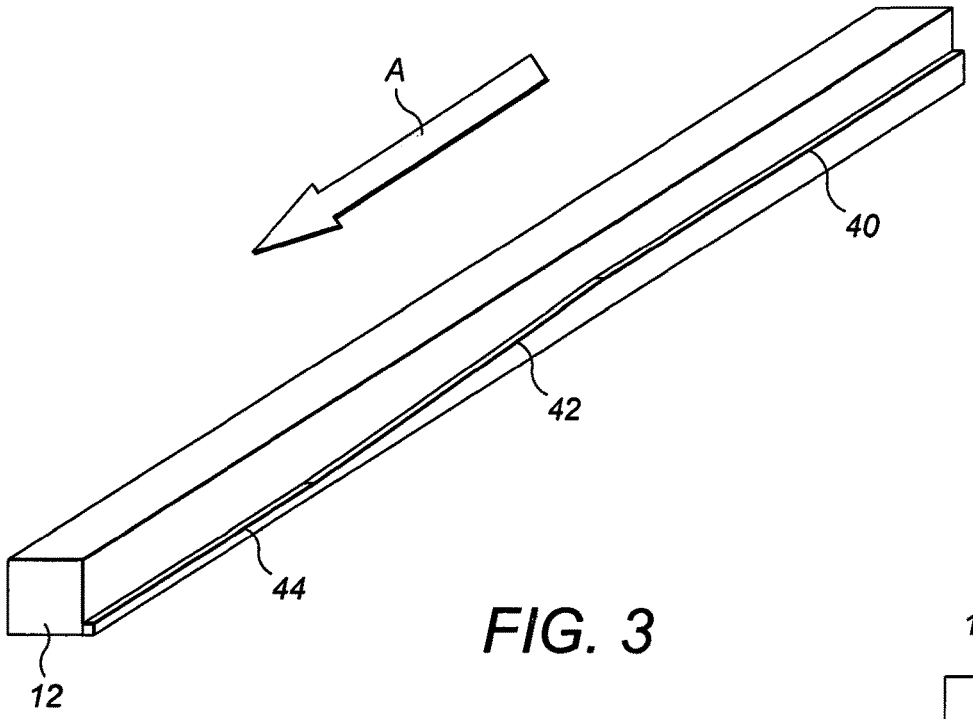
FIG. 3 shows a perspective view of one half of the track shown in FIG. 2.
Figure 4:
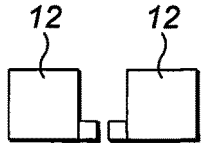
FIG. 4 shows an end of view of the track.
Figure 5:
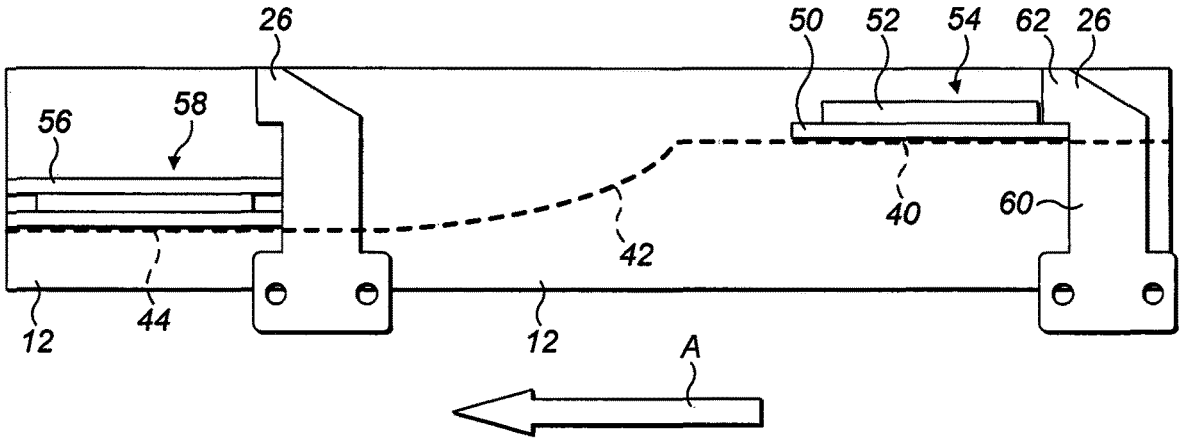
FIG. 5 shows a cross-section of a part of a track of the apparatus as shown in FIG. 1.

A perspective view of one half of the guide track 12 is shown in FIG. 3. The other half of the guide track is identical except that it is a mirror image of the half shown in FIG. 3. FIG. 4 shows an end on view of track 12, with the two halves facing one another. The two halves of the track 12 are mounted independently of one another such that they are adjustable relative to one another so the gap between them may be altered. Each half of the guide track 12 (hereafter referred to as "the track") comprises a first rail section 40, in this example provided as a recessed edge, which has an upper edge which is substantially flat and defines a first plane of travel. The guide track 12 further comprises a second rail section 44, also provided as a recess, which also has a substantially flat upper surface and defines a second plane of travel. The first plane of travel 40 is offset from the second plane of travel 44. An intermediate rail section 42, also provided as a recess, provides a transition between the first rail section 40 and second rail section 44. In the example shown the first plane is above the second plane. That is to say the first rail section 40 is above second rail section 44. As shown in FIG. 2, the intermediate section 42 may be substantially flat. An alternative example of the track 12 is shown in FIG. 5, which will be referred to in more detail later. However, as shown in FIG. 4, the intermediate rail section 42 may be curved.

The bearing surface 36 is arranged relative to the track rails 40,42,44 such that the distance between the bearing surface 36 and the track rails 40,42,44 decreases in the direction of travel along the track 12 and the bearing surface 36. Hence at entry to the compression frame sections 30,32,34, the bearing surface is a first distance "x" from the guide track rails 40,42,44 and at exit from the compression frame sections 30,32,34, the bearing surface 36 is a second distance "y" from the track rails 40,42,44. In FIG. 3, "x" and "y" are shown for third compression frame section 34, although the same applies for the other sections. The first distance "x" is greater than the second distance "y".

In the example shown, the compression frame sections 30,32,34 are configured such that the distance between the bearing surface 36 and the track rails reduces at one rate to a point part way along the length of the compression frame sections 30,32,24, and then further reduces at a lower rate along the rest of the length of the compression frame sections 30,32,34, coming to a minimum height towards the exit point from each of the compression frame sections 30,32,34.

In an alternative example, the compression frame sections 30,32,34 are configured such that the distance between the bearing surface 36 and the track rails reduces to a minimum part way along the length of the compression frame sections 30,32,24, and then remains at a substantially constant distance from the guide track rails 12 along the rest of the length of the compression frame section 30,32,34.

In operation a base element 50 (for example a piece of card or flat cover) is introduced to the rails of the guide track 12 from the first feeder 16. One of the flights 26 moves the base element 50 along the rail 40. The first glue gun 22 deposits glue on the base element 50 as it passes underneath the glue gun 22. The flight 26 moves the base element 50 to a position where a resilient element 52 (for example a folded sheet of paper), ejected from the second feeder 18, is located on top of the base element 50 to form a first combination 54. The lip 62 of the flight 26 rests against the resilient element 52, and the waist 60 rests against the base element 50, thus locating the resilient element 52 offset from the edge of the base element 50.

The first combination 54 is then moved along the rail 40 in the direction of arrow A by the flight 26 such that it slides underneath the first compression frame section 30 such that the bearing surface 36 acts to compress the resilient element 52 and press the resilient element 52 and the base element 50 together. Hence, when the first combination 54 is moved along the rails of the guide track 14 and compressed by the compression frame 14 the base element 50 and resilient element 52 are pressed together while the glue forms a bond. In the example shown the first combination 54 passes through an exit from the first compression frame section 30, and enters an entry point to the second compression frame section 32 to continue the compression.

The first combination 54 is moved to a position beneath the second glue gun 24 where further glue is provided on a top surface of the first combination 54.

The first combination 54 is then urged along the intermediate rail section 42 by the flight 26. A top element 56 (for example a piece of card or flat cover) is then introduced from the third feeder 20, and sits on the upper surface of the second frame section 32 until caught by the flight 26 as the flight 26 passes between the rods of the compression frame. The flight 26 thus urges the first combination 54 along the intermediate rail 42, and the top element 56 along the second frame section together. When the top element drops off the end of the second compression frame section 32, the first combination 54 has reached the second (lower) rail section 44, and is thus further down the flight 26, away from the lip 62 of the flight 26, resting instead against flight waist 60. Hence the ends of the base element 50 and top element 56 are aligned, as shown in FIG. 5, as the top element 56 and first combination 54 are brought together to form a second combination 58. The second combination 58 is then moved along the guide track 12 such that the third compression frame section 34 acts to compress the resilient element 52 and press the first combination 54 and top element 56 together to thereby bond the first combination 54 and top element 56 together.

Upon completion, the second combination (a folded document) exits the compression frame 14.

There is thus provided a binder apparatus and method for the production of folded documents, where the folded sheet (the resilient element) is compressed by the compression frame as it passes through the apparatus, thereby preventing its resilience resulting in misalignment of the base and top elements relative to the resilient element. Running speeds of 14,000 article per hour are possible with apparatus and method of the present invention.

Although preferred embodiment(s) of the present invention have been shown and described, it will be appreciated by those skilled in the art that changes may be made without departing from the scope of the invention as defined in the claims.

The invention claimed is:

1. An apparatus for manufacturing an article, comprising:

a guide track that defines a path along which two or more elements to be bonded together to form the article travel during manufacture, the two or more elements comprising a resilient element;

one or more feeders positioned along the guide track, the one or more feeders for introducing the two or more elements to the guide track to form a combination of elements; and, a compression frame positioned along at least a portion of a length of the guide track, the compression frame compressing the resilient element as the resilient element travels along the path defined by the guide track;

wherein the guide track comprises a first rail section that is flat and defines a first plane of travel, a second rail section that is flat and defines a second plane of travel offset from the first plane of travel, and an intermediate rail section positioned between the first rail section and second rail section to provide a transition between the first rail section and second rail section;

wherein the first plane of travel is located vertically above the second plane of travel.

2. The apparatus of claim 1, the compression frame comprising at least one bearing surface that, in use, applies a compression force on the elements moving along the guide track.

3. The apparatus of claim 1, the intermediate rail section being concave.

4. The apparatus of claim 1, further comprising a flight for urging the elements along the guide track.

5. The apparatus of claim 1, the compression frame comprising at least a first section and a second section, the first section and the second section (1) being aligned with one another along at least a portion of a length of the guide track and (2) being independently mounted such that relative positions of the first section and the second section with respect to one another may be adjusted.

6. The apparatus of claim 2, the bearing surface being arranged relative to track rails of the guide track such that a distance between the bearing surface and the track rails decreases in a direction of travel of the elements along the bearing surface.

7. The apparatus of claim 6, the bearing surface being configured such that the distance between the bearing surface and the track rails reduces at a first rate along a first portion of a length of the bearing surface in the direction of travel, and then reduces at a second rate along a second portion of the length of the bearing surface in the direction of travel, the second rate being less than the first rate.

8. The apparatus of claim 1, the intermediate rail section being flat.

9. The apparatus of claim 1, further comprising one or more glue guns positioned along the guide track, the one or more glue guns for introducing glue onto the two or more elements to the guide track to form a combination of elements.

10. An apparatus for manufacturing an article, comprising:

a guide track that defines a path along which two or more elements to be bonded together to form the article travel during manufacture, the two or more elements comprising a resilient element;

one or more feeders positioned along the guide track, the one or more feeders for introducing the two or more elements to the guide track to form a combination of elements; and, a compression frame positioned along at least a portion of a length of the guide track, the compression frame compressing the resilient element as the resilient element travels along the path defined by the guide track;

wherein the compression frame comprises at least one bearing surface that, in use, applies a compression force on the elements moving along the guide track, wherein the bearing surface is being arranged relative to track rails of the guide track such that a distance between the bearing surface and the track rails decreases in a direction of travel of the elements along the bearing surface, wherein the bearing surface is configured such that the distance between the bearing surface and the track rails reduces at a first rate along a first portion of a length of the bearing surface in the direction of travel, and then reduces at a second rate along a second portion of the length of the bearing surface in the direction of travel, the second rate being less than the first rate.

11. The apparatus of claim 10, the guide track comprising a first rail section that is flat and defines a first plane of travel, a second rail section that is flat and defines a second plane of travel offset from the first plane of travel, and an intermediate rail section positioned between the first rail section and second rail section to provide a transition between the first rail section and second rail section.

12. The apparatus of claim 11, the first plane of travel being located vertically above the second plane of travel.

13. The apparatus of claim 11, the intermediate rail section being concave.

14. The apparatus of claim 10, further comprising a flight for urging the elements along the guide track.

15. The apparatus of claim 10, the compression frame comprising at least a first section and a second section, the first section and the second section (1) being aligned with one another along at least a portion of a length of the guide track and (2) being independently mounted such that relative positions of the first section and the second section with respect to one another may be adjusted.

16. The apparatus of claim 11, the intermediate rail section being flat.

17. The apparatus of claim 10, further comprising one or more glue guns positioned along the guide track, the one or more glue guns for introducing glue onto the two or more elements to the guide track to form a combination of elements.

* * * * *